US007458869B2

(12) United States Patent
Tsumiyama et al.

(10) Patent No.: US 7,458,869 B2
(45) Date of Patent: Dec. 2, 2008

(54) PERSONAL WATERCRAFT

(75) Inventors: Yoshinori Tsumiyama, Miki (JP); Takahide Komoriya, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/517,549

(22) Filed: Sep. 5, 2006

(65) Prior Publication Data

US 2007/0056495 A1 Mar. 15, 2007

(30) Foreign Application Priority Data

Sep. 7, 2005 (JP) ..... 2005-259035

(51) Int. Cl.
*B63B 35/73* (2006.01)

(52) U.S. Cl. ..... 440/88 A

(58) Field of Classification Search ..... 440/88 A
See application file for complete search history.

(56) References Cited

U.S. PATENT DOCUMENTS

2002/0025743 A1* 2/2002 Pelletier et al. ..... 440/88
2003/0131776 A1* 7/2003 Nakajima et al. ..... 114/55.51
2004/0154513 A1* 8/2004 Matsuda ..... 114/55.53

FOREIGN PATENT DOCUMENTS

JP HEI4-125997 11/1992

* cited by examiner

*Primary Examiner*—Stephen Avila
(74) *Attorney, Agent, or Firm*—Alleman Hall McCoy Russell & Tuttle LLP

(57) ABSTRACT

A personal watercraft having an air-water separating structure to communicate the outside of a body of the watercraft with an interior of an engine room, which allows the layout of the interior of an engine room to be designed flexibly, including a body 1 including a hull 2 and a deck 3 covering the hull 2 from above, a water jet pump P configured to eject rearward water sucked from a water intake 17 provided on a bottom surface of the hull 2, an engine room 8 that is formed at a front portion of the body 1 and is configured to accommodate an engine E for driving the water jet pump P, and an engine hood 16 covering a deck opening formed on a region of the deck that is located above the engine room 8, wherein the engine hood 16 is equipped with an air-water separating structure 33 having upper air passages 27 and 28 through which a front space formed in a front portion in the engine hood 16 and outside of the body communicate with each other and a lower air passage 29 through which the front space in the engine hood 16 and a region at a predetermined depth position in an interior of the engine room 8 communicate with each other.

8 Claims, 6 Drawing Sheets

PERSONAL WATERCRAFT

BACKGROUND OF THE INVENTION

1. Field of the Invention

The present invention relates to a personal watercraft. More particularly, the present invention relates to a personal watercraft having an air-water separating structure to inhibit entry of water into an engine room when the watercraft is banked, for example.

2. Description of the Related Art

In recent years, jet-propulsion personal watercraft have been widely used in leisure, sport, or rescue activities. The personal watercraft is equipped with a water jet pump that pressurizes and accelerates water sucked from a water intake provided on a hull and ejects it rearward. As the resulting reaction, a body of the watercraft is propelled forward.

There are stand-up type personal watercraft and straddle-type personal watercraft. The stand-up type personal watercraft includes a concave portion having a flat bottom portion called a standing deck at a rear portion of a deck, which is a space intended for a rider. Standing on the bottom portion at the center of the concave portion, the rider grips a steering handle located in front to steer the watercraft. An engine room is formed in an interior of a body of the watercraft and is located forward of the standing deck. The straddle-type personal watercraft is equipped with a seat that extends from a substantially middle portion to a rear portion over the deck and is configured to be straddled by the rider. Straddling the seat, the rider grips and steers the steering handle located forward on the watercraft. Typically, the engine room is formed in the interior of the body to be located below the seat. In general, the straddle-type personal watercraft can accommodate several persons. As used herein, "forward" is the traveling direction of the watercraft, and "rearward" is the opposite direction.

The above described personal watercraft is devised so that a large amount of water does not enter the engine room even when the body is banked or inverted in a lateral direction thereof. By way of example, the applicant of the present invention filed a patent application of the invention relating to an engine hood that is provided with air inlets that are located at one of right and left sides of a front portion of the engine hood and at an opposite side of a rear portion thereof so as to be spaced apart from each other, and air-intake ducts that are coupled to the corresponding air inlets and are configured to extend in the lateral direction in an engine room and to have openings in the interior of the engine room to form independent air introducing means respectively connected to the engine room. By providing the independent front and rear air introducing means formed of the air inlets and the air-intake ducts, the air inlets or openings of the air-intake ducts into the engine room are located in the air, and thus entry of the water from the outside of the body into the engine room is inhibited even when the body is banked in the lateral direction (e.g., Japanese Utility Model Application Publication No. Hei. 4-125997).

However, the engine room of the personal watercraft is narrow. When providing the air inlets and the ducts at the front portion and the rear portion of the right and left sides of the engine hood, they are required to be laid out so as not to contact an engine, an exhaust pipe, a propeller shaft, etc. As a result, they cannot not be laid out flexibly. In particular, since the rear portion of the engine hood is narrow because of a construction to mount the handle, it is sometimes difficult to lay out or design the duct so that the duct extends in the lateral direction from the rear portion of the engine hood.

For example, it is sometimes difficult to design the body of the watercraft so as to improve its appearance when changing a shape of a portion below a handle of the body of the personal watercraft for one rider's use, because of the layout of the air inlets and the ducts.

SUMMARY OF THE INVENTION

In view of the foregoing, an object of the present invention is to provide a personal watercraft having an air-water separating structure to communicate the outside of a body of the watercraft with the interior of an engine room, which allows the layout of the interior of the engine room to be designed flexibly.

To achieve the above object, a personal watercraft of the present invention comprises a body including a hull and a deck covering the hull from above; a water jet pump configured to eject rearward water sucked from a water intake provided on a bottom surface of the hull; an engine room that is formed at a front portion of the body and is configured to accommodate an engine for driving the water jet pump; and an engine hood covering a deck opening formed on a region of the deck that is located above the engine room; wherein the engine hood is provided with an air-water separating structure having a front space formed in a front portion of the engine hood, an upper air passage through which the front space and outside of the body communicate with each other, and a lower air passage through which the front space in the engine hood and a region at a predetermined depth position in an interior of the engine room communicate with each other. These air passages refer to air supply and exhaust passages through which the outside of the body communicate with the engine room. The predetermined depth position refers to a depth position that is located downward relative to the engine hood so that the opening of the lower air passage that is located within the engine room is located in the air when the body is banked. Thereby, even when the body is banked, the center region of the front side of the upper air passage can be located in the air to inhibit entry of the water into the engine room. In addition, the layout of the interior of the engine room can be designed flexibly.

The upper air passage may include a rear upper air passage that opens in an outside region of the body that is located behind the engine hood and in the front space in the engine hood, and a front upper air passage that opens in an outside region of the body that is located in front of the engine hood and in the front space in the engine hood. Thereby, the air can be supplied to or exhausted from the engine hood from forward or from rearward of the engine hood.

The rear upper air passage may include a passage that extends forward from a rear portion of the engine hood through a side portion in the interior of the engine hood and is bent toward a body center line at a front side in the interior of the engine hood so as to open in a center region in a lateral direction of the front space. Thereby, the air-water separating structure can be constructed so that the air passage extending from the rear portion of the engine hood to the front space in the engine hood can be laid out flexibly.

The lower air passage may include a plurality of passages formed to be spaced apart from each other rightward and leftward at the front portion in the interior of the engine hood. Thus, the lower air passage with a required cross-sectional area that opens in the predetermined depth position can be provided by utilizing the space at the front portion of the engine room.

The engine hood may include a hood cover forming an outer surface of the engine hood, and a hood base that is disposed inward of the hood cover and forms an inner surface of the engine hood, and the front space is formed between the hood cover and the hood base. Thus, the front space can be formed by utilizing the space between the hood cover and the hood base forming the engine hood.

A float may be disposed between the hood cover and the hood base. Thus, the float can be provided by utilizing the space between the hood cover and the hood base.

A seal member may be provided on a lower surface of the hood base and is configured to contact an upper surface of the deck to seal a periphery of the deck opening. The seal member can seal a region between the hood base and the upper surface of the deck.

The above and further objects and features of the invention will more fully be apparent from the detailed description with accompanying drawings.

DETAILED DESCRIPTION OF PREFERRED EMBODIMENTS

Figure 1:
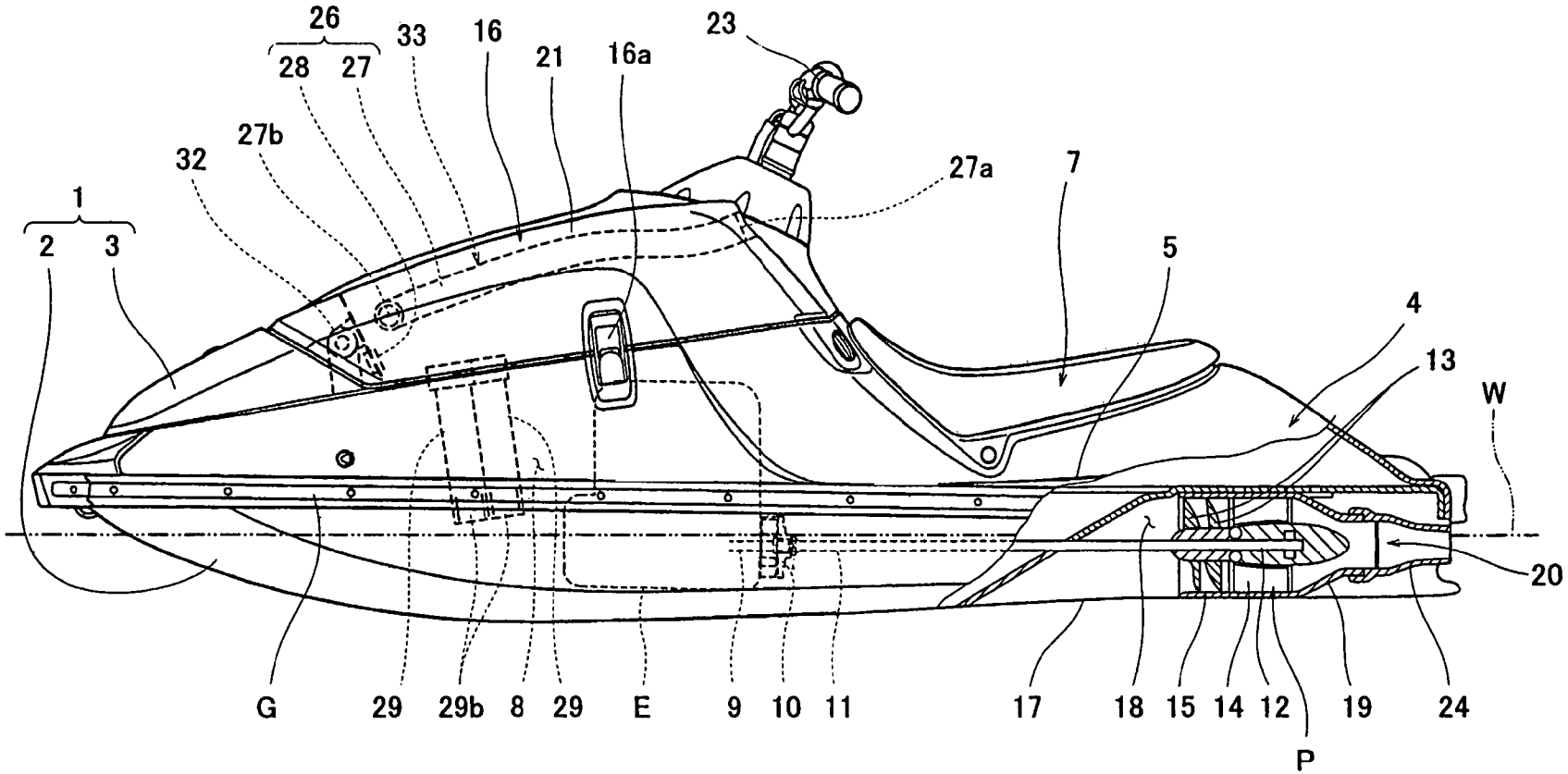
FIG. 1 is a side view of a personal watercraft according to an embodiment of the present invention, a part of which is cut away.
Figure 2:
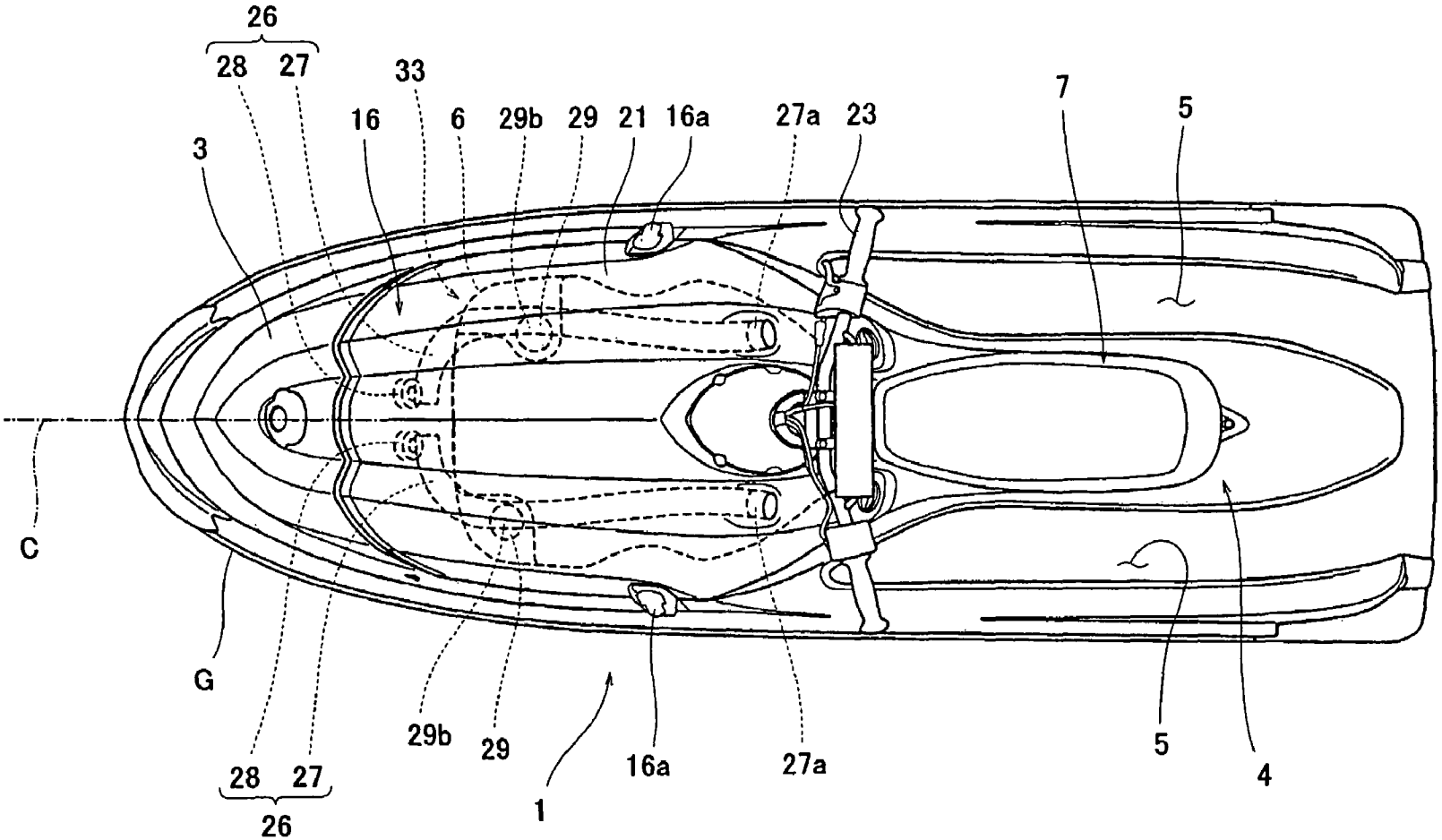
FIG. 2 is a plan view of the personal watercraft of FIG. 1.

Hereinafter, an embodiment of the present invention will be described with reference to the drawings. FIG. 1 is a side view of a personal watercraft according to the embodiment of the present invention, a part of which is cut away. FIG. 2 is a plan view of the personal watercraft. Hereinbelow, a straddle-type personal watercraft for one rider's use will be described.

A personal watercraft illustrated in FIGS. 1 and 2 is a straddle-type personal watercraft equipped with a seat 7 straddled by a rider. A body 1 of the watercraft includes a hull 2 and a deck 3 covering the hull 2 from above. To enable the rider to ride in the watercraft in a straddling position, a swelling portion 4 is formed at a center section in a width direction of a relatively rear portion of the deck 3 to be raised upward. The seat 7 is mounted over an upper surface of the swelling portion 4. A deck floor 5 is formed on right and left sides of the swelling portion 4 to be substantially flat and lower than the swelling portion 4 to enable the rider's feet to be put thereon. The deck floor 5 is a standing deck when the rider rides in the watercraft in a standing position. A line at which the hull 2 and the deck 3 are connected over the entire perimeter thereof is called a gunnel line G. In FIG. 1, reference symbol W denotes a waterline of the watercraft and the gunnel line G is located above the waterline W.

A deck opening 6 is formed at a substantially center position in a lateral direction at a front side of the deck 3 of an upper portion of the body 1 (as indicated by a broken line in FIG. 2). An engine hood 16 is openably mounted above the deck opening 16. The engine hood 16 is mounted at a front portion thereof to a front portion of the body 1 by a hinge member 32 and is pivoted upward around the hinge member 32 so as to open its rear portion. Substantially intermediate regions in a longitudinal direction of both sides of the engine hood 16 are fastened to the deck 3 by fastener members 16*a*. A space defined by the hull 2 and the deck 3 below the deck opening 6 forms the engine room 8. In other words, the engine room 8 of the personal watercraft is formed in a space surrounded by the hull 2 and the deck 3 that is located forward of the seat 7.

An engine E is mounted in the interior of the engine room 8 to drive the personal watercraft. The configuration of the engine E is not specifically limited. The engine E is mounted such that a crankshaft 9 extends along the longitudinal direction of the body 1. An output end of the crankshaft 9 is coupled to a propeller shaft 11 by a coupling means 10. The propeller shaft 11 is coupled to a pump shaft 12 of the water jet pump P mounted on the rear side of the body 1. The pump shaft 12 is configured to rotate in association with the crankshaft 9. An impeller 13 is attached on the pump shaft 12. Fairing vanes 14 are disposed behind the impeller 13. A tubular pump casing 15 is provided at outer peripheries of the impeller 13 and the faring vanes 14 to cover the impeller 13 and the faring vanes 14.

A water intake 17 is provided on a bottom portion of the hull 2 of the body 1. The water intake 17 is connected to the pump casing 15 through a water passage 18. A pump nozzle 19 is provided on the rear side of the body 1 and is coupled to the pump casing 15. The pump nozzle 19 has a cross-sectional area that is gradually reduced rearward, and an outlet port 20 is provided on the rear end of the pump nozzle 19.

In the above constructed personal watercraft, water is drawn from the water intake 17, through the water passage 18, and to the water jet pump P. The water jet pump P pressurizes and accelerates the water, and the fairing vanes 14 guide water flow. The water is ejected rearward through the pump nozzle 19 and from the outlet port 20. As the reaction of the water ejected from the outlet port 20, the watercraft obtains a propulsion force.

A steering handle 23 is located forward of the seat 7. The handle 23 is coupled to a steering nozzle 24 behind the pump nozzle 19 via a cable (not shown). When the handle 23 is rotated to the right or to the left, the steering nozzle 24 is pivoted to the right or to the left. Therefore, the handle 23 is steered so that the ejection direction of the water being ejected through the pump nozzle 19 can be changed, and thereby the watercraft can be correspondingly turned to any desired direction, while the water jet pump P is generating a propulsion force.

Figure 3:
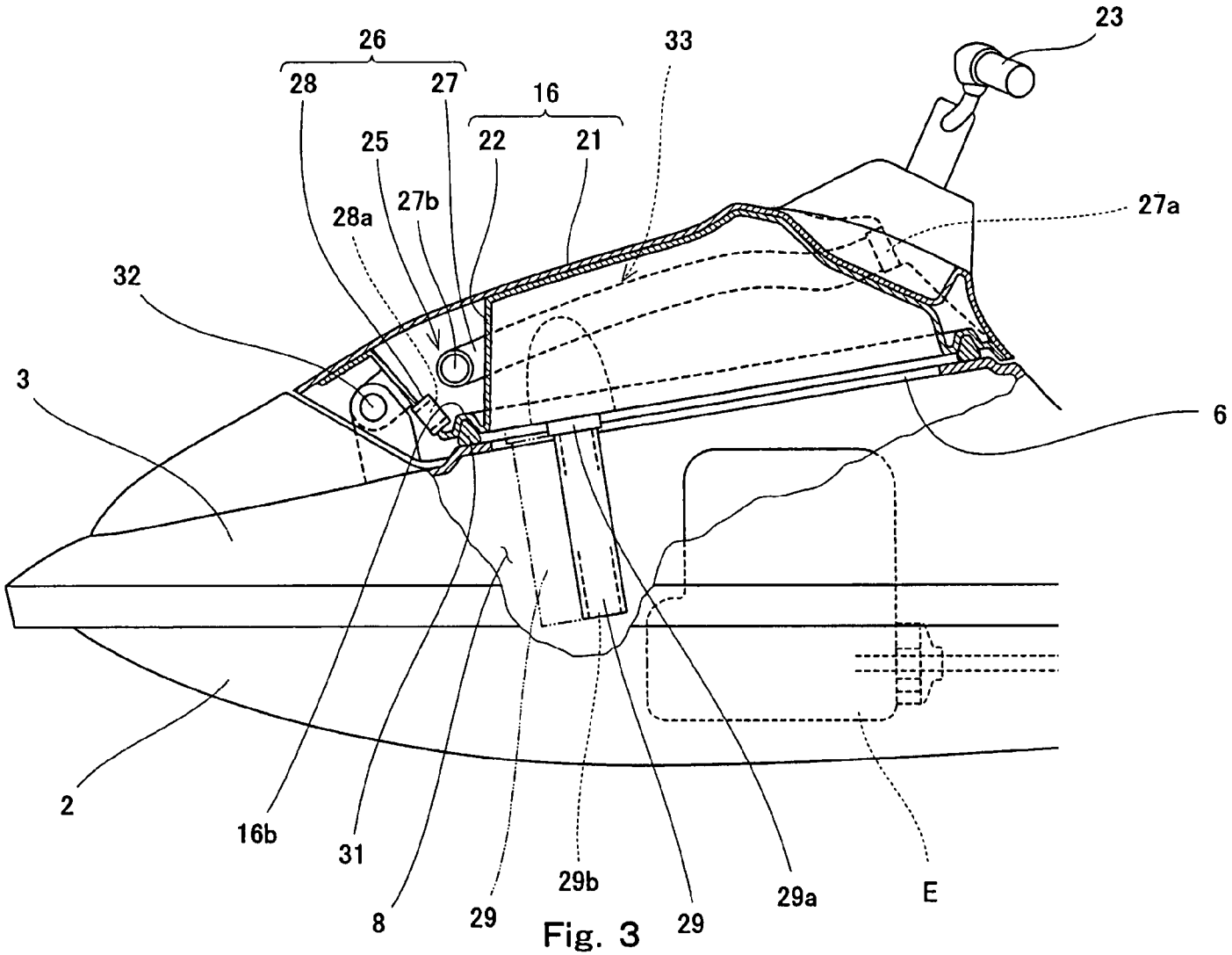
FIG. 3 is a partial cross-sectional side view showing a major configuration at a front portion of the personal watercraft of FIG. 1.
Figure 4:
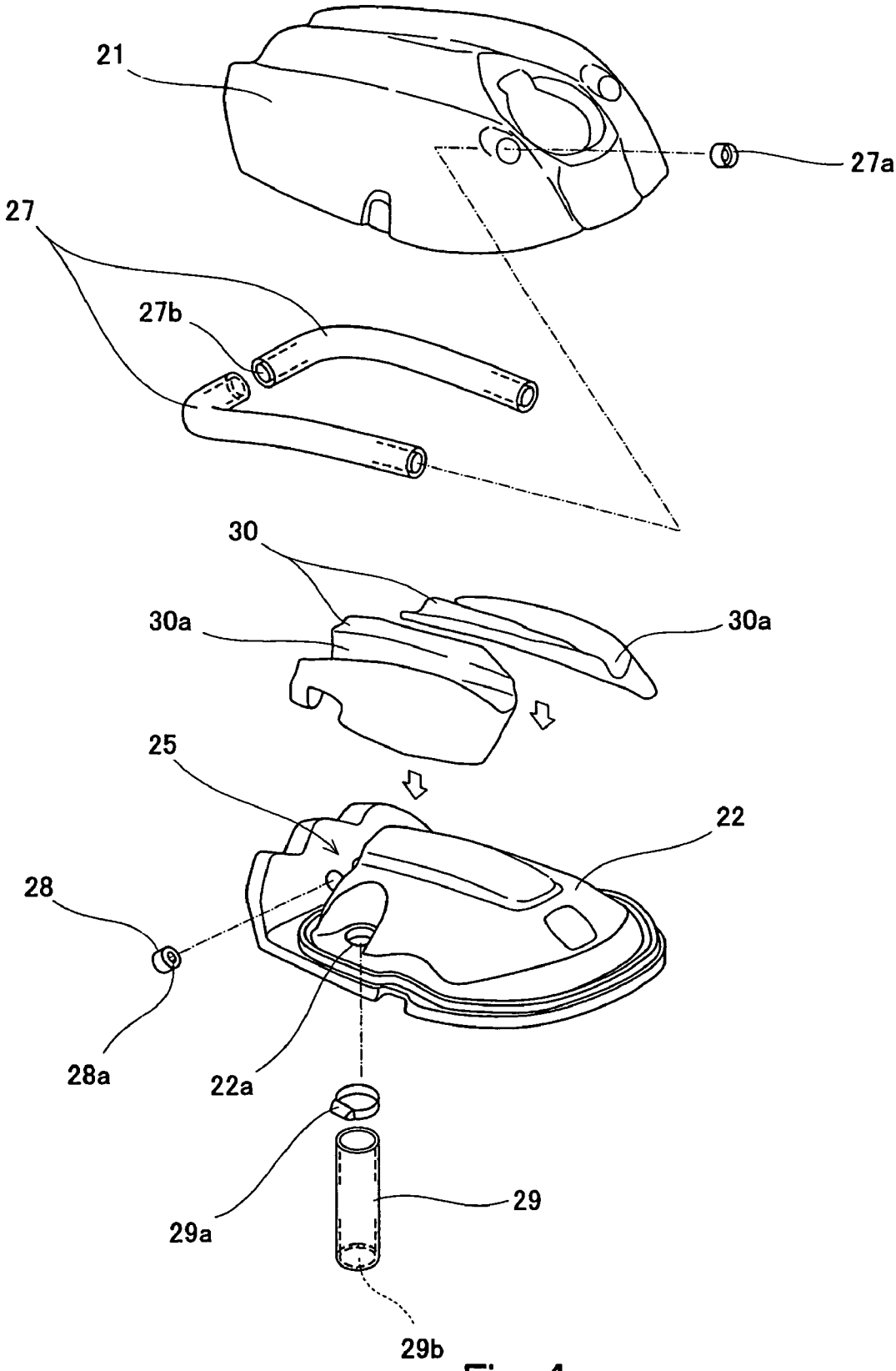
FIG. 4 is an exploded perspective view of an engine hood of the watercraft of FIG. 1.
Figure 5:
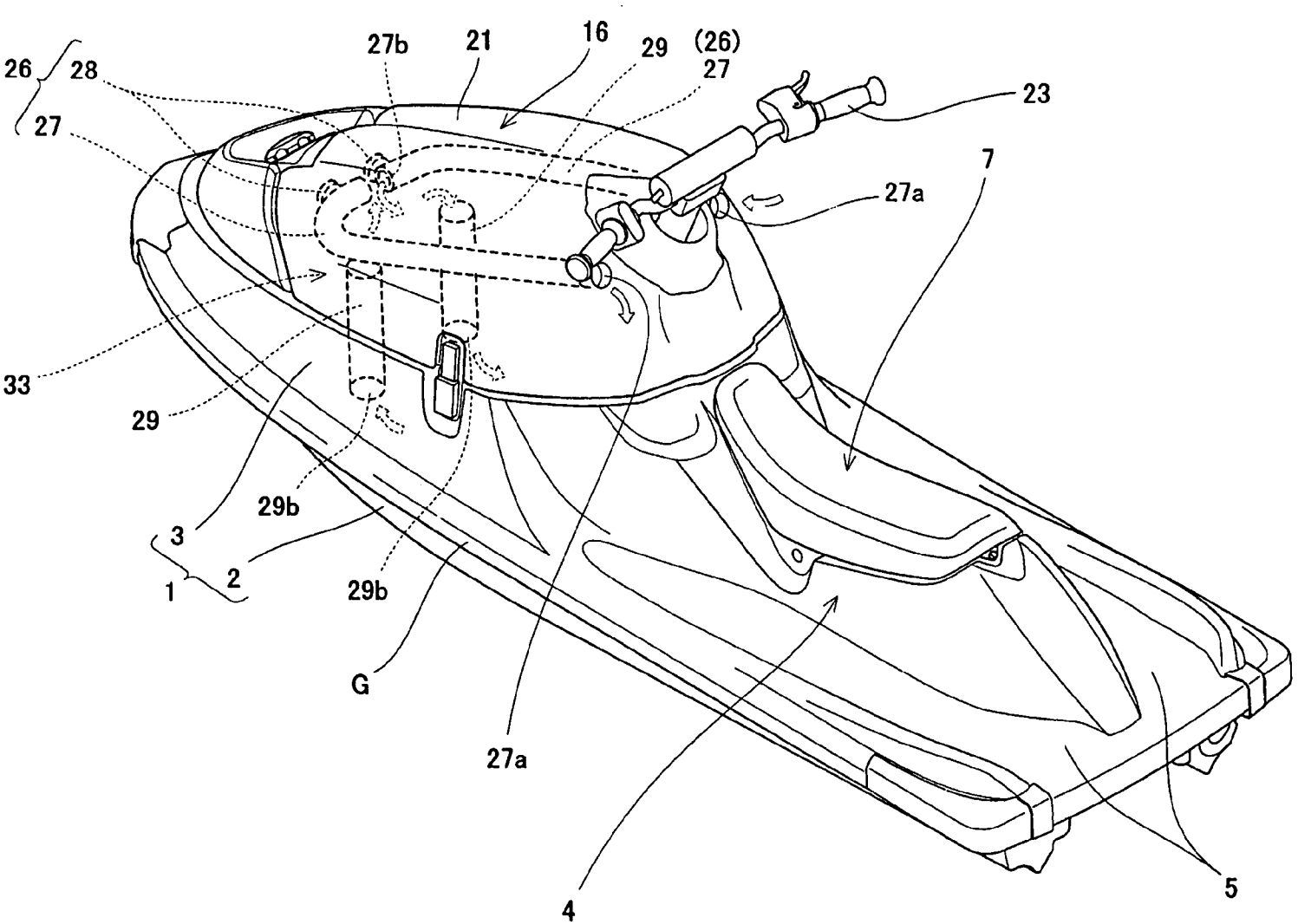
FIG. 5 is a perspective view of the personal watercraft of FIG. 1 as viewed from leftward and behind, showing an air-water separating structure.

FIG. 3 is a partial cross-sectional side view of a part of the personal watercraft of FIG. 1, including the engine hood. FIG. 4 is an exploded perspective view of an engine hood of FIG. 1. FIG. 5 is a perspective view of an air-water separating structure of the personal watercraft of FIG. 1 as viewed from leftward and behind. FIG. 3 shows a cross-section of the engine hood 16 that is obtained by sectioning a center portion in the lateral direction thereof, along a longitudinal direction thereof. In FIGS. 3 and 4, the left side indicates a front side of the body.

As shown in FIG. 3, the engine hood 16 has a double structure including an outer hood cover 21 and an inner hood base 22 which are integrally joined to each other. A front space 25 is formed between the hood cover 21 and the hood base 22 at a front portion of the engine hood 16. Upper air supply and exhaust ducts 26 forming upper air passages are disposed in the front space 25. Each upper air supply and exhaust duct 26 includes a rear upper air supply and exhaust duct 27 extending from a rear portion of the engine hood 16 to the front portion of the engine hood 16 in the interior of the engine hood 16 (in this figure, upper air supply and exhaust duct 26 on the right side of the body that is covered with the hood base 22 is illustrated) and a front upper air supply and exhaust duct 28 disposed at the front portion of the engine hood 16. The rear upper air supply and exhaust ducts 27 are mounted at rear ends thereof to openings formed at a rear end portion of the engine hood 16 by fastener members 27*a*. Openings 27*b* formed at front ends of the rear upper air supply and exhaust ducts 27 are disposed in the front space 25 in the interior of the engine hood 16. Two front upper air supply and exhaust ducts 28 are arranged closer to a body center of a front wall of the hood base 22 forming the front space 25. Openings 28*a* of the front upper air supply and exhaust ducts 28 are located in the front space 25. In this illustrated example, the upper air supply and exhaust ducts 27 and 28 are provided to supply and exhaust the air from forward and from rearward, but may alternatively be provided to supply and exhaust the air from one of forward and rearward according to the amount of air supply and exhaust.

Thus, the openings 27*b* formed at end portions of the rear upper air supply and exhaust ducts 27 disposed within the engine hood 16 are located in the front space 25 in the interior of the engine hood 16 to allow the outside of the body of the watercraft and the front space 25 in the engine hood 16 to thereby communicate with each other. The front upper air supply and exhaust ducts 28 open in the front space 25 of the engine hood 16 to thereby allow the outside of the body to communicate with the front space 25 in the engine hood 16.

Lower air supply and exhaust ducts 29 are formed at a region below the hood base 22 so as to extend from the front space 25 formed between the hood base 22 and the hood cover 21 to a predetermined depth in the interior of the engine room 8. Openings 29*b* formed at lower ends of the lower air supply and exhaust duct 29 are located in the interior of the engine room 8. In this example, the two lower air supply and exhaust ducts 29 are spaced to be substantially equal from a center of the body and extend from the engine hood 16 to a predetermined depth in the engine room 8 (in this embodiment, to a substantially center of the height of the engine room 8). The predetermined depth position to which the lower air supply and exhaust ducts 29 extend from the engine hood 16 to the interior of the engine room 8 is set so that the openings 29*b* formed at the lower ends are located in the air above the waterline W to inhibit entry of water even when the body 1 is inverted (see FIG. 7 as described later). This position is set depending on a structure of the body 1, a buoyant force of the front portion of the body 1, a capacity of the engine room 8, etc.

In this example, as shown in FIG. 2, the lower air supply and exhaust duct 29 on the right side (upper side in FIG. 2) is located rearward in the body 1 approximately by a duct diameter length relative to the lower air supply and exhaust duct 29 on the left side (lower side in FIG. 2). These lower air supply and exhaust ducts 29 are located in front of the engine E on the front side of the body 1. This layout is exemplary and may be changed depending on the internal structure of the engine room 8.

Thus, through the lower air supply and exhaust ducts 29 disposed at the front portion of the engine hood 16, the front space 25 of the engine hood 16 and a region at the predetermined depth position of the engine room 8 communicate with each other.

Furthermore, a seal groove 16*b* is formed over an entire periphery of a lower surface of the engine hood 16, to be specific, a lower surface of the hood base 22. A seal member 31 is attached on the seal groove 16*b* to seal the periphery of the lower surface of the engine hood 16. The seal member 31 seals the periphery of the lower surface of the deck opening 16.

As shown in FIG. 4, the engine hood 16 is constructed such that the hood cover 21, the rear upper air supply and exhaust ducts 27, right and left floats 30, the hood base 22, and the front upper air supply and exhaust ducts 28 are integral with each other. The lower air supply and exhaust ducts 29 are mounted to the hood base 22 of the integral engine hood 16.

The hood cover 21 is provided with openings 21*a* at right and left positions of a rear portion thereof. Rear ends of the rear upper air supply and exhaust ducts 27 are fastened to the openings 21*a* by fastener members 27*a*. The rear upper air supply and exhaust ducts 27 extend from the rear portion of the engine hood 16, through the side portions of the engine hood 16, to the front portion of the engine hood 16, and are bent inward toward a body center line C (FIG. 2) at the front portion of the engine hood 16 such that the openings 27*b* formed at front ends thereof are located at a center region of the body 1.

The floats 30 have enlarged side portions to generate the buoyant force at the side portions of the engine hood 16, and are provided with concave grooves 30*a* which are formed closer to the center of the body 1 to extend in an axial direction of the body 1 to allow the rear upper air supply and exhaust ducts 27 to be disposed therein.

The two front upper air supply and exhaust ducts 28 are provided at the center region of the front portion of the hood base 22 (only one duct is illustrated). The front upper air supply and exhaust ducts 28 are arranged on right and left sides to be spaced equally from the body center line C (FIG. 2). The lower air supply and exhaust ducts 29 are disposed in the front portion of the hood base 22 to be spaced apart from each other in the lateral direction (only one duct is illustrated). The lower air supply and exhaust ducts 29 are fastened by mounting members 29*a* to mounting bracket portions (not shown) formed to extend downward from penetrating holes 22*a* formed on the hood base 22.

As shown in FIG. 5, in the air-water separating structure 33 constructed above, the outside of the body 1 and the front space 25 (FIG. 3) in the engine hood 16 communicate with each other, through the rear upper air supply and exhaust ducts 27 that extend from the rear portion of the engine hood 16 toward the front space 25 (FIG. 3) in the engine hood 16 and open in the front space 25 of the engine hood 16 and the front upper air supply and exhaust ducts 28 that open in the front space 25 of the engine hood 16, and the front space 25 in the engine hood 16 communicates with the interior of the engine room 8 through the lower air supply and exhaust ducts 29 extending to the predetermined depth position in the engine room 8 at the front portion of the engine hood 16.

Therefore, in a normal state shown, the air is supplied from the front upper air supply and exhaust duct 28 or the rear upper air supply and exhaust duct 27 to the interior of the engine room 8 through the front space 25 in the engine hood 16, and the air in the engine room 8 is exhausted from the front upper air supply and exhaust duct 28 or the rear upper air supply and exhaust duct 27 through the front space 25 in the engine hood 16. The air is suitably supplied and exhausted to and from the engine room 8 through either the air supply and exhaust duct 27 or 28 depending on air condition or the state of the interior of the engine room 8.

Figure 6:
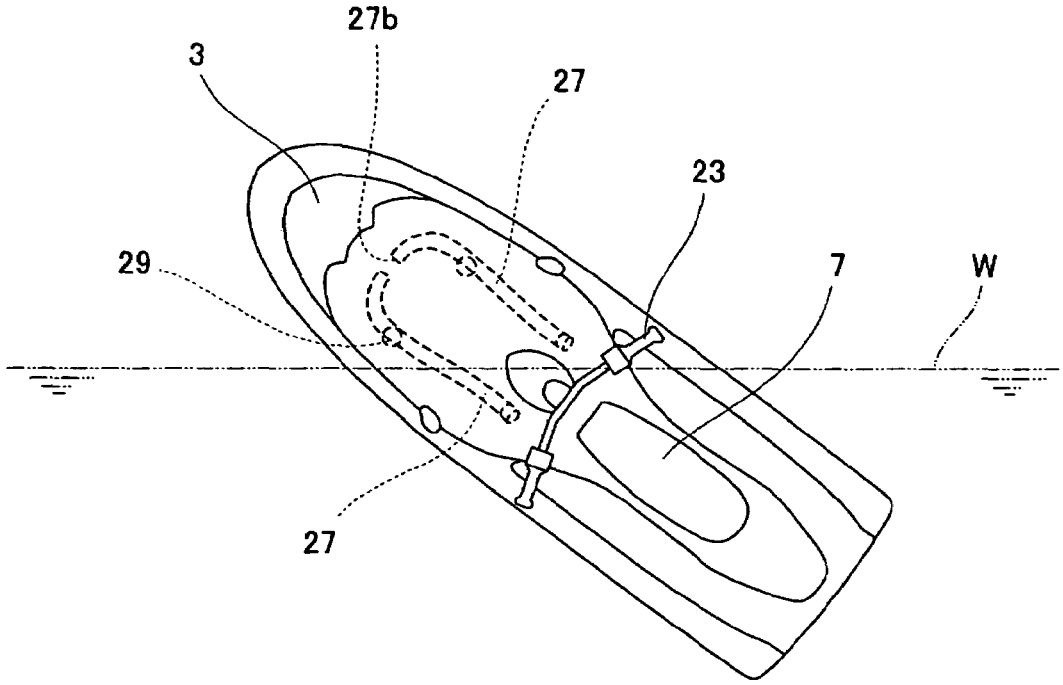
FIG. 6 is a side view of the personal watercraft of FIG. 1, which is banked 90 degrees in a lateral direction thereof.
Figure 7:
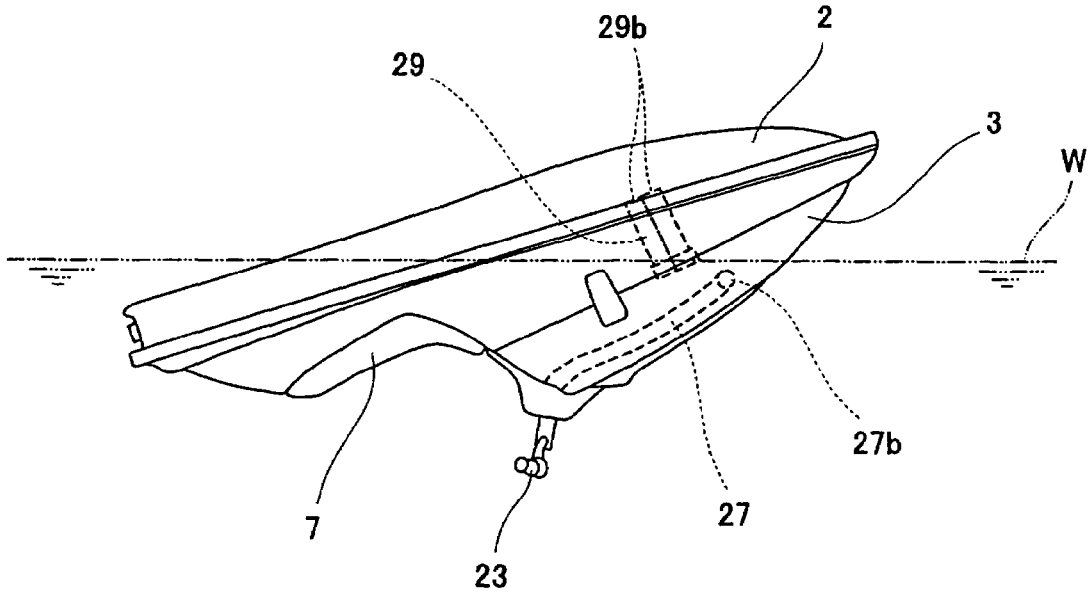
FIG. 7 is a side view of the personal watercraft of FIG. 1, which is inverted 180 degrees.

FIG. 6 is a side view of the personal watercraft of FIG. 1 which is banked 90 degrees in the lateral direction, and FIG. 7 is a side view of the personal watercraft which is inverted 180 degrees. With reference to these Figures, two examples of a case where the personal watercraft having the air-water separating structure 33 constructed above is banked to the right or to the left will be described.

As shown in FIG. 6, when the body 1 is tiled 90 degrees in the lateral direction, the front portion of the body 1 floats and the body 1 is banked because of a large volume on the engine room 8 of the front portion of the body 1. For this reason, the openings 27*b* of the rear upper air supply and exhaust ducts 27 that are located closer to center on the front side of the body 1 are located in the air, making it possible to inhibit entry of water into the engine hood 16 through the openings 27*b* of the rear upper air supply and exhaust ducts 27 under the state in which rear portions of the rear upper air supply and exhaust ducts 27 are immersed in the water. In this case, since the openings 28*a* of the front upper air supply and exhaust ducts 28 are also located in the air, the water does not enter the engine hood 16 through the openings 28*a* of the front upper air supply and exhaust ducts 28. Therefore, even when the body 1 is banked in this way, it is possible to inhibit entry of the water into the engine room 8 from the outside of the body 1 through the upper air supply and exhaust ducts 27 and 28 and the engine hood 16.

As shown in FIG. 7, when the body 1 is inverted 180 degrees and the rear portion of the engine hood 16 is immersed in the water, the front portion of the body 1 floats and the body 1 is banked because of a large volume of the engine room 8 of the front portion of the body 1. In this state, the upper air supply and exhaust ducts 27 and 28 disposed in the interior of the engine hood 16 are immersed in the water. However, since the openings 29*b* formed at the lower ends of the lower air supply and exhaust ducts 29 extending from the interior of the engine hood 16 to the predetermined depth position are located in the air, it is possible to inhibit entry of the water into the engine room 8 from the outside of the body 1 through the upper air supply and exhaust ducts 27 and 28 and the lower air supply and exhaust ducts 29. In this case, the water enters the upper air supply and exhaust ducts 27 and 28 and the front space 25 in the interior of the engine hood 16, but no more water enters the engine room 8 when the body 1 is returned to its original position. Upon driving the water jet pump P, the water within the engine room 8 is discharged from the interior of the engine room 8 by a bilge discharge system of the water jet pump P.

By providing the air-water separating structure 33 to inhibit entry of the water into the engine room 8 at the front portion of the engine hood 16, the lower air supply and exhaust ducts 29 which would be otherwise difficult to lay out depending on the construction associated with the handle 23 attached to the rear portion of the engine hood 16 or the construction of the rear portion of the engine, can be disposed relatively flexibly. As a result, design flexibility of the layout of the interior of engine room 8 can be increased.

Whereas in this embodiment, the engine hood 16 is provided with the two rear upper air supply and exhaust ducts 27 and the two front upper air supply and exhaust ducts 28, one rear upper air supply and exhaust duct 27 and one front upper air supply and exhaust duct 28, it may alternatively be provided with three or more rear upper air supply and exhaust ducts 27 and three or more front upper air supply and exhaust ducts 28, or a combination thereof, according to the amount of air supply and exhaust, so long as the opening formed closer to the center on the front side of the body 1 is located in the air to inhibit entry of water from the outside of the body 1 even when the body 1 is banked to the right or to the left.

Whereas in this embodiment, the two lower air supply and exhaust ducts 29 are provided at the front portion of the engine hood 16, one lower air supply and exhaust duct 29 may be provided at the center, or three or more lower air supply and exhaust ducts 29 may be provided according to the amount of air supply and exhaust, the construction of the engine, etc., so long as the opening located closer to the center on the front side of the body 1 is located in the air to inhibit entry of water from the outside of the body 1 even when the body 1 is banked to the right or to the left.

The above described embodiment is merely exemplary and may be altered without departing the from scope of the present invention, and the present invention is not intended to be limited to the above described embodiment.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

a body including a hull and a deck covering the hull from above;

a water jet pump configured to eject rearward water sucked from a water intake provided on a bottom surface of the hull;

an engine room that is formed at a front portion of the body and is configured to accommodate an engine for driving the water jet pump; and an engine hood covering a deck opening formed on a region of the deck that is located above the engine room;

wherein the engine hood is provided with an air-water separating structure having a front space formed in a front portion of the engine hood, an upper air passage through which the front space and outside of the body communicate with each other, and a lower air passage through which the front space of the engine hood and a region at a predetermined depth position in an interior of the engine room communicate with each other, and wherein the upper air passage includes a rear upper air passage extending forward and rearward in a side portion within the engine hood such that the rear upper air passage does not extend across a body center line and opens in a right region or a left region in a rear portion of the engine hood, to connect the front space in the engine hood to an outside region of the body that is located behind the engine hood.

2. The personal watercraft according to claim 1, wherein the upper air passage further includes a front upper air passage that opens in an outside region of the body that is located in front of the engine hood and in the front space in the engine hood.

3. The personal watercraft according to claim 1, wherein the rear upper air passage includes a passage that extends forward substantially in parallel with the body center line from the rear portion of the engine hood through a side portion in the interior of the engine hood and is bent toward the body center line at a front side in the interior of the engine hood so as to open in a center region in a lateral direction of the front space.

4. The personal watercraft according to claim 1, wherein the lower air passage includes a plurality of passages formed to be spaced apart from each other rightward and leftward at the front portion in the interior of the engine hood.

5. The personal watercraft according to claim 1, wherein the engine hood includes a hood cover forming an outer surface of the engine hood, and a hood base that is disposed inward of the hood cover and forms an inner surface of the engine hood, and the front space is formed between the hood cover and the hood base.

6. The personal watercraft according to claim 5, wherein a float is disposed between the hood cover and the hood base.

7. The personal watercraft according to claim 6, wherein a seal member is provided on a lower surface of the hood base and is configured to contact an upper surface of the deck to seal a periphery of the deck opening.

8. The personal watercraft according to claim 5, wherein the rear upper air passage is positioned between the hood cover and the hood base to extend forward and rearward.

* * * * *